US006341587B1

(12) United States Patent
Speil et al.

(10) Patent No.: US 6,341,587 B1
(45) Date of Patent: Jan. 29, 2002

(54) LEVER-TYPE CAM FOLLOWER FOR A VALVE TRAIN OF AN INTERNAL COMBUSTION ENGINE

(75) Inventors: Walter Speil, Ingolstadt; Arndt Ihlemann, Herzogenaurach; Martin Jakel, Altendorf, all of (DE)

(73) Assignee: INA Walzlager Schaeffler oHG (DE)

( * ) Notice: Subject to any disclaimer, the term of this patent is extended or adjusted under 35 U.S.C. 154(b) by 0 days.

(21) Appl. No.: 09/591,153

(22) Filed: Jun. 9, 2000

(30) Foreign Application Priority Data

Jun. 11, 1999 (DE) ..... 199 26 646

(51) Int. Cl.[7] ..... F01L 1/18

(52) U.S. Cl. ..... 123/90.44; 123/90.39; 29/888.2

(58) Field of Search ..... 123/90.39, 90.42, 123/90.41, 90.44; 74/559, 519; 29/888.2

(56) References Cited

U.S. PATENT DOCUMENTS 4,727,832 A * 3/1988 Miyamura ..... 123/90.44
4,796,483 A * 1/1989 Patel ..... 74/519
4,959,261 A 9/1990 Igarashi
5,074,261 A * 12/1991 Hamburg ..... 123/90.39
5,375,323 A * 12/1994 Sata ..... 29/888.1
5,655,490 A * 8/1997 Nagano ..... 123/90.41

FOREIGN PATENT DOCUMENTS

DE 4023885 1/1992

OTHER PUBLICATIONS

Patent Abstracts of Japan Dec. 21, 1993, vol. 17, No. 701 2 pages.

* cited by examiner

*Primary Examiner*—Thomas Denion
*Assistant Examiner*—Jaimie Corrigan
(74) *Attorney, Agent, or Firm*—Bierman, Muserlian and Lucas

(57) ABSTRACT

The invention proposes a lever-type cam follower (1) which, for mounting a pin (7) for a cam roller, comprises bores (5, 6) in the region of its side walls (2, 3). The diameter of the bore (5) is larger than the diameter of the bore (6). Corresponding ends (8, 9) of the pin (7) are configured so that when mounted, the pin (7) is fixed in the bores (5, 6) by a press fit. Thus, the pin (7) can be inserted with its second end (8) at first through the larger bore (5) without causing damage to its raceway (8*a*) during assembly. At the same time, the press fit guarantees an excellent fixture of the pin (7) in the cam follower (1) with an all-round contact.

9 Claims, 1 Drawing Sheet

Fig. 1
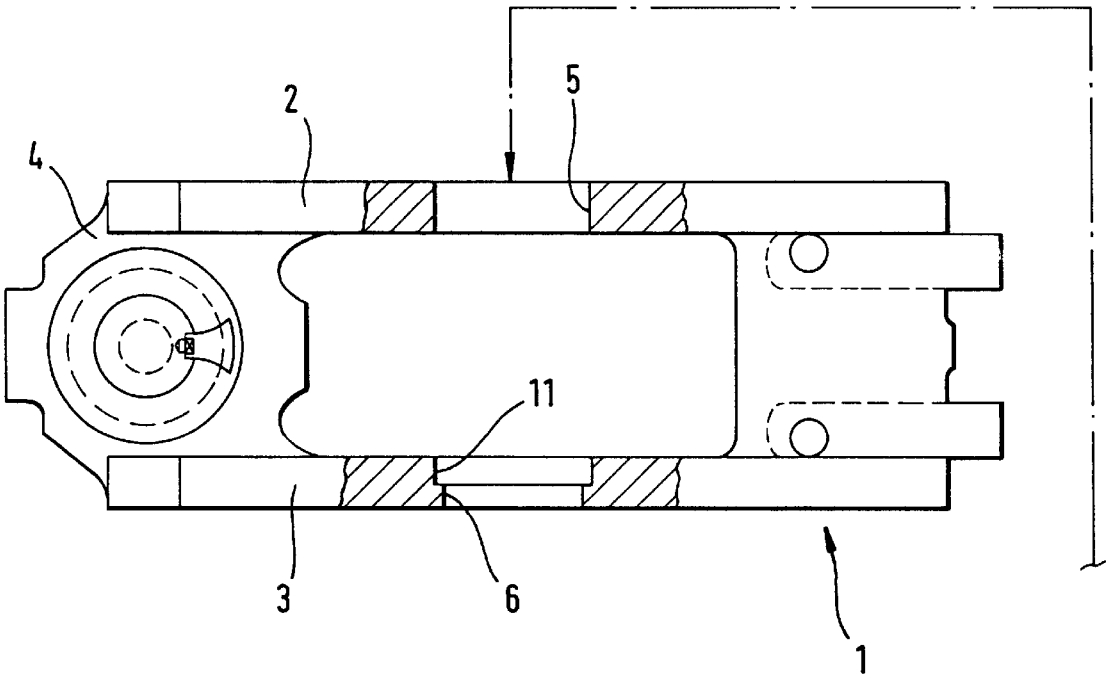
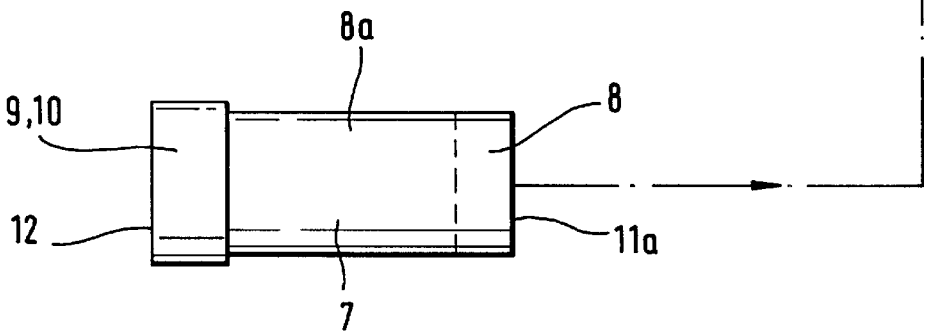
Fig. 2

LEVER-TYPE CAM FOLLOWER FOR A VALVE TRAIN OF AN INTERNAL COMBUSTION ENGINE

FIELD OF THE INVENTION

The invention concerns a lever-type cam follower for a valve train of an internal combustion engine comprising:

a first and a second side wall connected to each other by a cross-beam, a first bore configured in the first side wall as an insertion bore for a pin for mounting a cam roller, the pin being mounted in the first bore by a first end, a second bore aligned to the first bore being configured for the pin in the second side wall, the pin being mounted in this second bore by a second end, said pin comprising between the first and the second side walls a raceway for the cam roller or for rolling elements of the cam roller.

BACKGROUND OF THE INVENTION

A generic cam follower of the pre-cited type is disclosed in FIG. 2 of GB-A 2 233 418. In this cam follower, the pin for mounting a cam roller on a rolling bearing is fixed in the side walls of the cam follower by swaged ends. One of the bores in the side walls serves as an insertion bore for the pin. Normally, the tolerance of the diameter of the pin relative to the bores of the side walls is chosen so as to obtain a clearance fit. In this way, the pin can be easily inserted with its second end through the first bore that is configured as an insertion bore. Problems can occur with this assembly method if the tolerance of the diameter of the pin relative to the diameters of the bores is unfavorable. This can result in a damage to the raceway arranged on the pin. Such damage which can take the form of scratches, for example, has a negative influence on the running behavior of the roller and, in the worst case, can lead to a premature failure of the rolling bearing mounting arrangement.

On the other hand, if the clearance in the clearance fit is too large, or if the tolerances are situated in the boundary range, i.e. if a small pin diameter is paired with a large bore diameter, problems can occur with the swaging of the pin. The contact pattern obtained may be inadequate or the swaging force may have to be unnecessarily increased. If the swaging force is too large, the material deformation may extend into the region of the raceway of the pin.

OBJECTS OF THE INVENTION

It is an object of the invention to improve a cam follower of the pre-cited type in which the aforesaid drawbacks are eliminated. More particularly, the invention aims at creating a cam follower whose pin can be mounted and fixed without influencing the raceway of the cam roller.

These and other objects and advantages of the invention will become obvious from the following detailed description.

SUMMARY OF THE INVENTION

The invention achieves the above objects by the fact that the diameter of the first bore is larger than the diameter of the raceway and also larger than the diameter of the second end of the pin, and the diameter of the second bore is smaller than the diameter of the second end of the pin.

The measures provided by the invention eliminate the aforementioned drawbacks. The pin is connected at least at its second end by a press fit to the bore provided therefor. Due to the fact that the diameter of the first bore is larger than the diameter of second bore, the pin can be inserted with great ease through the first bore, which is configured as an insertion bore, and then fixed by a press fit in the second bore.

According to a further advantageous feature of the invention, the pin may likewise be fixed with its first end in the first bore by a press fit. This can be implemented, for example, with the help of an annular enlargement of the first end of the pin. Alternatively, the pin may be fixed in the first bore by swaging. Thus, at least at its end situated in the second bore, the pin possesses an excellent contact pattern.

From the manufacturing point of view, it may be advantageous to make the pin with a uniform diameter over its entire length so that it can be ground in a single work step (centerless continuous grinding). The annular enlargement can then be made thereafter by deposition of a layer of material, for example, by chromium-plating, phosphatizing or bronzing. However, as already mentioned above, it is also possible to omit the annular enlargement and fix the first end of the pin by way of compromise in the first bore only by swaging.

According to a further feature of the invention, the annular enlargement may be made by a machining method such as grinding or by a non-chipping method like upsetting or another similar method.

A stepped configuration of the second bore, as further proposed by the invention, renders the mounting of the pin very simple because it is then easier to insert the second end of the pin into the second bore.

Considered as whole, the use of the inventive means makes it possible to fix each, or at least one end of the pin by a press fit in the bore concerned without detriment to the raceway for the cam roller or the rolling elements of the cam roller, during the mounting of the pin.

The invention is related to every kind of lever-like cam follower but more particularly to rocker arms, oscillating arms and finger levers. The cam follower may be made by creative forming, i.e. from shapeless material by creation of material cohesion, but it can also be made from sheet material by deep drawing.

The invention will now be described more closely with reference to the drawings.

BRIEF DESCRIPTION OF THE DRAWINGS

FIG. 1 is a top view of the cam follower of the invention, bores for the pin being shown in section, and FIG. 2 shows the pin.

DETAILED DESCRIPTION OF THE DRAWINGS

FIG. 1 discloses a lever-type cam follower 1 for a valve train of an internal combustion engine. In this figure, the cam follower 1 is configured as a finger lever, and a closer description thereof is not necessary in the present context. The cam follower 1 comprises a first and a second side wall 2, 3 that are parallel to each other and connected by a cross wall 4. As viewed in cross-section, the side walls 2, 3 and the cross wall 4 together form a U-shaped profile.

A first bore 5 configured as an insertion bore is arranged approximately in the region of a central transverse plane in the first side wall 2. This bore is aligned to a second bore 6 provided in the second side wall 3. A pin 7 (see FIG. 2) is inserted with its second end 8 through this bore 5 designated as an insertion bore. This pin 7 serves to mount a cam roller, preferably through rolling elements, in the cam follower 1. The pin 7 comprises an approximately central raceway 8*a* and a first end 9 which extends in the assembled state in the first bore 5.

In the prior art discussed above, the pin is fixed in the side walls 2, 3, i.e. in the bores 5, 6 thereof by a clearance fit. By a swaging of its end faces 11*a*, 12, the pin 7 is fixed relative to the cam follower 1. This swaging and mounting of the pin 7 are accompanied by the drawbacks described above.

The measures proposed by the invention eliminate these drawbacks with the use of simple means. According to the invention, the diameter of the first bore 5 is larger than the diameter of the raceway 8*a* and also larger than the diameter of the second end 8 of the pin 7. This enables the pin 7 to be inserted through the first bore 5 without damage to its raceway 8*a*. Due to the fact that the second bore 6 has a smaller diameter than the second end 8 of the pin 7, the pin 7 is retained in the second bore 6 by a press fit. Although it is possible, if the pin 7 has a constant diameter over its entire length, to retain the pin 7 in the region of the first bore 5, for example, by a swaging, it is more advantageous to provide the pin 7 with an annular enlargement 10 in the region of its first end 9. The pin 7 can then be fixed through this annular enlargement 10 in the first bore 5 likewise by a press fit. The diameter of the first bore 5 is thus larger than the diameter of the second bore 6.

Due to the two press fits, the pin 7 exhibits a desired contact pattern in the bores 5, 6 around its entire periphery. The pin 7 is therefore securely fixed all through the operation of the cam follower 1.

The annular enlargement 10 may be made, for example, by a chipping method such as grinding or by a non-chipping manufacturing method such as upsetting. However, as already mentioned earlier in the discussion of advantages of the invention, the annular enlargement 10 can also be made by the deposition of a layer of material.

Due to the fact that the raceway 8*a* is no longer damaged by the first bore 5 during the mounting of the pin 7, the running behavior of the rolling elements of the cam roller is distinctly improved compared to the prior art.

As can be seen additionally in FIG. 1, the second bore 6 may also have a stepped configuration. The axially inner section 11 of the bore 6 then has a larger diameter than the second end 8 of the pin 7 and an axially outer part of the bore 6. This simplifies the mounting of the pin 7 because its second end 8 can be inserted more easily into the second bore 6.

It is, of course, also additionally conceivable to swage at least one of the end faces 11*a*, 12 of the pin 7 or to use another securing means such as a locking ring.

What is claimed is:

1. A lever-type cam follower for a valve train of an internal combustion engine comprising:

a first and a second side wall connected to each other by a cross-beam, a first bore configured in the first side wall as an insertion bore for a pin for mounting a cam roller, the pin being mounted in the first bore by a first end, a second bore aligned to the first bore being configured for the pin in the second side wall, the pin being mounted in this second bore by a second end, said pin comprising between the first and the second side walls a raceway for the cam roller or for rolling elements of the cam roller, a diameter of the first bore being larger than a diameter of the raceway and also larger than a diameter of the second end of the pin, while a diameter of the second bore is smaller than the diameter of the second end of the pin and has a stepped configuration, an axially inner section of the second bore having a larger diameter than the second end of the pin.

2. A cam follower of claim 1 wherein the raceway and the second end of the pin have a same, constant diameter.

3. A cam follower of claim 1 wherein the first end of the pin is fixed in the first bore by swaging.

4. A cam follower of claim 1 wherein the second bore tapers in axially outward direction, an axially inner section of the second bore having a larger diameter than the second end of the pin.

5. A lever-type cam follower for a valve train of an internal combustion engine comprising:

a first and a second side wall connected to each other by a cross-beam, a first bore configured in the first side wall as an insertion bore for a pin for mounting a cam roller, the pin being mounted in the first bore by a first end, a second bore aligned to the first bore being configured for the pin in the second side wall, the pin being mounted in this second bore by a second end, said pin comprising between the first and second side walls a raceway for the cam roller or for rolling elements of the cam roller, a diameter of the first bore being larger than the diameter of the raceway and also larger than a diameter of the second end of the pin, while a diameter of the second bore is smaller than the diameter of the second end of the pin and the diameter of the first bore is smaller than a diameter of the first end of the pin which first end is configured as an annular enlargement.

6. A cam follower of claim 5 wherein the annular enlargement is integral to the pin and made by a machining method.

7. A cam follower of claim 5 wherein the annular enlargement is made by grinding.

8. A cam follower of claim 5 wherein the annular enlargement is integral to the pin and is made by upsetting.

9. A cam follower of claim 5 wherein the annular enlargement is made by a deposition of a layer of material.

* * * * *